US010153099B2

(12) United States Patent
Abroy

(10) Patent No.: US 10,153,099 B2
(45) Date of Patent: Dec. 11, 2018

(54) KNIFE BLADE SWITCH CONTACT WITH HIGH RESISTANCE PORTION

(71) Applicant: SCHNEIDER ELECTRIC USA, INC., Andover, MA (US)

(72) Inventor: Hamid S. Abroy, Murfreesboro, TN (US)

(73) Assignee: SCHNEIDER ELECTRIC USA, INC., Andover, MA (US)

( * ) Notice: Subject to any disclaimer, the term of this patent is extended or adjusted under 35 U.S.C. 154(b) by 0 days.

(21) Appl. No.: 15/128,522

(22) PCT Filed: Mar. 27, 2014

(86) PCT No.: PCT/US2014/031964
§ 371 (c)(1),
(2) Date: Sep. 23, 2016

(87) PCT Pub. No.: WO2015/147824
PCT Pub. Date: Oct. 1, 2015

(65) Prior Publication Data

US 2017/0103858 A1 Apr. 13, 2017

(51) Int. Cl.
*H01H 1/04* (2006.01)
*H01H 1/42* (2006.01)
(Continued)

(52) U.S. Cl.
CPC ..... *H01H 1/42* (2013.01); *H01H 1/04* (2013.01); *H01H 9/34* (2013.01); *H01H 21/54* (2013.01)

(58) Field of Classification Search
CPC .. H01H 2235/01; H01H 13/14; H01H 19/563; H01H 1/2041; H01H 2071/048;
(Continued)

(56) References Cited

U.S. PATENT DOCUMENTS 2,224,380 A 12/1940 Crabbs et al.
2,243,741 A 5/1941 Rowe
(Continued)

FOREIGN PATENT DOCUMENTS

WO WO2011000838 1/2011

OTHER PUBLICATIONS

International Search Report and Written Opinion dated Aug. 22, 2014 in PCT/US2014/031964, 10 pp.
(Continued)

*Primary Examiner* — Truc Nguyen
(74) *Attorney, Agent, or Firm* — Locke Lord LLP

(57) ABSTRACT

The invention disclosed is a knife blade switch 2 having copper jaws 10 and a copper blade 4 with a steel end-plate 6 fastened to the free end of the blade, the steel end-plate having a higher resistivity than the resistivity of the copper blade and copper jaws. As the copper blade is withdrawn from the copper jaws, the steel end-plate of the blade remains in contact with a higher resistivity steel jaw-spring mounted on and electrically connected to the copper jaws. The connection of the steel end-plate 6 of the blade with the steel jaw-spring 12 imposes a greater resistance path for the current flowing through the switch than through the copper blade 4 and copper jaws 10, so that an arc formed at the plate and jaw-spring has a diminished current, over what would otherwise occur with a copper blade and jaws, when the contact separation occurs.

8 Claims, 6 Drawing Sheets

(51) Int. Cl.
*H01H 21/54* (2006.01)
*H01H 9/34* (2006.01)

(58) Field of Classification Search
CPC ..... H01H 21/08; H01H 2300/024; H01H 36/0013; H01H 37/002; H01H 37/52; H01H 3/20; H01H 3/38; H01H 50/58; H01H 51/2263
See application file for complete search history.

(56) References Cited

U.S. PATENT DOCUMENTS 2,571,864 A 10/1951 Graybill
3,142,003 A 7/1964 Olashaw
3,240,888 A 3/1966 Rys et al.
3,335,399 A 8/1967 Rys
3,339,047 A 8/1967 Rys et al.
3,346,711 A 10/1967 Rys et al.
3,567,889 A * 3/1971 Latter ..... H01H 1/42 200/254
3,980,851 A * 9/1976 Evans ..... H01H 1/021 218/8
4,028,513 A 6/1977 Laubach
4,071,836 A * 1/1978 Cook ..... H01H 77/10 218/32
4,139,748 A 2/1979 Wolfe et al.
4,302,643 A 11/1981 Cox et al.
4,766,276 A 8/1988 Clark et al.
4,789,919 A 12/1988 Cox et al.
5,057,654 A 10/1991 Meyer et al.
5,160,817 A 11/1992 Wiktor et al.
5,322,982 A 6/1994 Leger et al.
5,510,960 A 4/1996 Rosen
5,583,328 A * 12/1996 Mitsuhashi ..... H01H 9/302 218/146
5,609,245 A 3/1997 Cassity et al.
5,635,692 A * 6/1997 Ward, Jr. ..... H01H 33/168 218/146
5,737,195 A 4/1998 Cassity et al.
57,394,888 4/1998 Cassity et al.
5,746,306 A 5/1998 Cassity et al.
5,777,283 A 7/1998 Greer
6,313,416 B1 * 11/2001 Abroy ..... H01H 1/42 200/15
6,331,684 B1 12/2001 Abroy et al.
6,373,014 B1 * 4/2002 Mitsuhashi ..... H01H 33/98 218/22
6,689,979 B1 * 2/2004 Bach ..... H01H 9/383 218/22
8,071,898 B2 * 12/2011 Bennett ..... H01H 77/104 200/244
8,476,546 B2 7/2013 Abroy
2004/0069749 A1 * 4/2004 Evans ..... H01H 33/187 218/154
2007/0111575 A1 5/2007 Jensen et al.
2008/0079436 A1 4/2008 Gollhardt et al.
2008/0258667 A1 10/2008 Morris et al.
2010/0118473 A1 5/2010 Morris et al.
2011/0110049 A1 5/2011 Lehtola et al.
2011/0149480 A1 6/2011 Leeman et al.
2012/0085736 A1 * 4/2012 Abroy ..... H01H 1/2066 218/149
2012/0127636 A1 5/2012 Abrahamsen et al.
2012/0228097 A1 9/2012 Gemme et al.
2013/0001201 A1 * 1/2013 Mittelstadt ..... H01H 9/46 218/148
2015/0014278 A1 * 1/2015 Kuruma ..... H01H 1/42 218/27
2016/0248232 A1 8/2016 Richards et al.

OTHER PUBLICATIONS

Robert Morel; Schneider Electric "Cahier Technique" No. 154.; LV circuit-breaker breaking techniques; ECT 154; Schneider Electric; Jun. 2000.
H. Schellekens; 50 Years of TMF Contacts; Design Considerations; Schneider Electric, 2008.

* cited by examiner

KNIFE BLADE SWITCH CONTACT WITH HIGH RESISTANCE PORTION

FIELD OF THE INVENTION

The invention disclosed relates to electrical switches.

BACKGROUND

Knife switches are used as disconnect switches mounted on switchboards, distribution, and control panel boards and typically are enclosed within safety switch cabinets. Knife switches are extensively used in heavy industries to handle heavy electrical loads, where visible disconnects are required. The switching of heavy currents produces arcing between the switch contacts, having the potential to cause considerable damage to the contacts and injury to operators. The contacts are typically formed of relatively soft, good conducting metals, such as copper, which have relatively low melting points and hence are very susceptible to damage by uncontrolled arcing. Past attempts to mitigate the problem of arcing-induced erosion have included providing two sets of contacts, main contacts that carry the load, and arcing contacts that open after the main contacts open and close before the main contacts close, so that the arc is drawn only between the arcing contacts and not between the main contacts. For example, U.S. Pat. No. 4,028,513 discloses a contact construction for a circuit breaker, wherein a pair of main contacts of relatively high conductivity are arranged in parallel with arcing contacts that have a steel body of relatively low conductivity. Such constructions of parallel sets of main contacts and arcing contacts are complex assemblies of parts that are expensive to manufacture and difficult to service for the replacement of eroded arcing contacts.

SUMMARY

The invention disclosed is a knife blade switch having a simplified construction to connect or disconnect a first electrical terminal and a second electrical terminal. The knife blade switch includes copper jaws, a steel-jaw spring and a copper blade. The copper blade has a body with a first end connected to pivot and a second end (e.g., a free end) with a steel end-plate fastened to it. The copper jaws are connected to the first electrical terminal and the copper blade is connected to the second electrical terminal. The steel end-plate and the steel-jaw spring have a higher resistivity than the resistivity of the copper blade and the copper jaws. In operation, as the switch is operated from a closed position toward an open position, the copper blade is disengaged from the copper jaws while the steel end-plate at the free end of the blade remains in contact with the steel jaw-spring mounted on the copper jaws. The connection of the steel end-plate of the blade with the steel jaw-spring imposes a greater resistance path for the current flowing through the switch than the resistance path through the copper blade and the copper jaws. As a consequence, any arc formed has a diminished current when the contact separation occurs. Less arc energy occurring during separation is easier to manage. Moreover, the steel end-plate and the steel-jaw spring have a higher melting point and higher hardness than the melting point and the hardness of the copper blade and the copper jaws. By relocating the arc to the steel end-plate and the steel-jaw spring, which occurs upon separation, arc erosion is substantially eliminated for the current carrying copper blade and the copper jaws. In this manner, good contact joint integrity is maintained when the switch is fully closed.

DESCRIPTION OF EMBODIMENTS OF THE INVENTION

At the start of opening an electrical switch, the area of the switch contacts that carries the electrical current diminishes, causing resistive heating and melting of the metal contact material in that area. When the contacts begin to actually separate, the electrical field strength in the small gap between the contacts is quite large and causes the air molecules to ionize, forming a plasma. The positively charged ions and negative electrons of the plasma are accelerated in the high electric field toward the respective contacts of opposite polarity and strike the metallic surfaces, causing spallation, evaporation and ionization of the metal atoms. An arc then forms between the contacts, along the conductive path created by the plasma and metal vapor. Metal atoms are eroded and ionized from the contact with the more positive potential, and are accelerated toward and deposited on the contact with the more negative potential (that temporarily exist at that particular moment in an AC cycle), resulting in arc erosion. As the switch contacts continue to separate, the electric field strength between the contacts is reduced sufficiently so that the plasma and metal vapor are no longer formed and the arc is extinguished. Arc erosion on the contacts of a switch impair good contact joint integrity when the switch is fully closed.

In accordance with an example embodiment of the invention, a knife blade switch has copper jaws and a copper blade with a steel end-plate fastened to the free end of the blade, the steel end-plate having a higher resistivity than the resistivity of the copper blade and copper jaws. As the copper blade is withdrawn from the copper jaws, the steel end-plate of the blade remains in contact with a higher resistivity steel jaw-spring mounted on and electrically connected to the copper jaws. The connection of the steel end-plate of the blade with the steel jaw-spring imposes a greater resistance path for the current flowing through the switch than the resistance path through the copper blade and copper jaws, so that an arc formed at the plate and jaw-spring has a diminished current, over what would otherwise occur with a copper blade and jaws, when the contact separation occurs. The diminished arc current reduces erosion of the copper jaws and copper blade of the switch.

Figure 1:
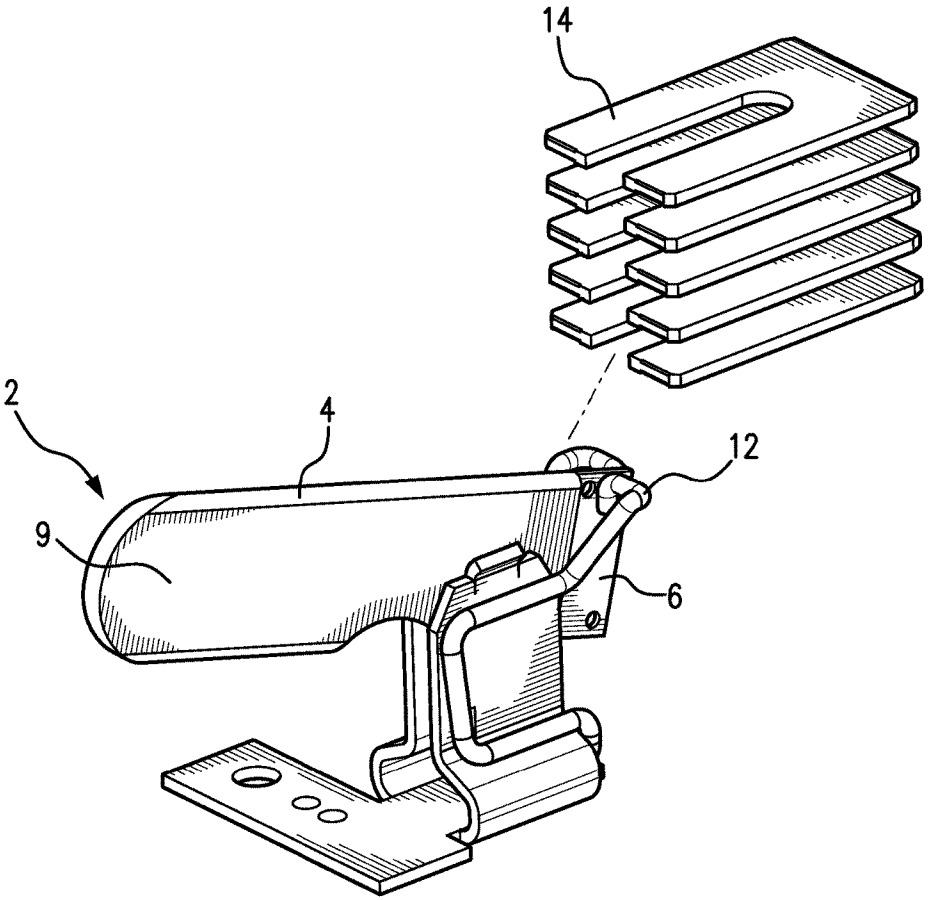
FIG. 1 shows a top perspective, exploded view from the right side, of the knife blade switch and its relationship to an arc chute.

FIG. 1 shows a top perspective, exploded view from the right side, of the knife blade switch 2 and its relationship to arc chute 14. The knife blade switch 2 may be mounted, for example, on a switchboard or control panel and may be enclosed within a safety switch cabinet. The knife blade switch 2 has a simplified construction to connect or disconnect a first electrical terminal and a second electrical terminal. The knife blade switch includes copper jaws 10 (shown in FIG. 2), a steel-jaw spring 12 and a copper blade 4. The copper blade has a body with a first end having a pivot 9 mounted on a pivot support 8 (shown in FIG. 2), and a second, free end with a steel end-plate 6 fastened to it. The copper jaws 10 are connected to the first electrical terminal and the copper blade 4 is connected to the second electrical terminal. The steel end-plate 6 and the steel-jaw spring 12 have a higher resistivity than the resistivity of the copper blade 4 and the copper jaws 10. The connection of the steel end-plate 6 of the blade with the steel jaw-spring 12 imposes a greater resistance path for the current flowing through the switch than the resistance path through the copper blade 4 and the copper jaws 10. As a consequence, any arc formed has a diminished current when the contact separation occurs.

An arc chute 14 is positioned at a location proximate to where the steel end-plate 6 of the blade disengages with the steel jaw-spring 12, to direct the arc and cool the hot arc gases. When the switch opens and the steel end-plate 6 moves up through the arc chute 14, the arc chute diverts the arc against an arc plate stack, to split the arc up into a number of elementary arcs, to dissipate the energy of the arc. The arc chute 14 may be fastened to the same base that supports the knife blade switch 2.

Figure 2:
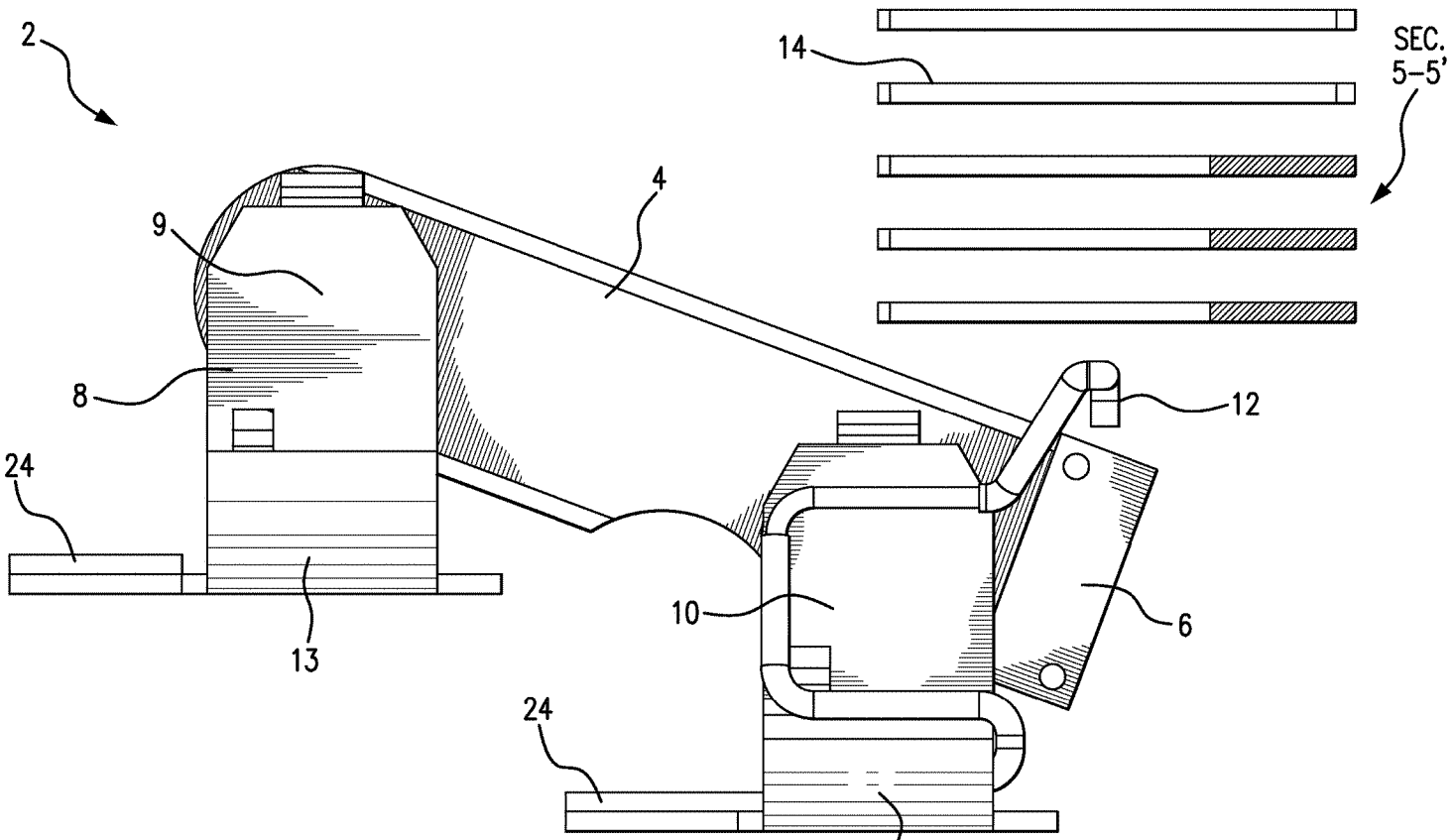
FIG. 2 shows a side view of an example embodiment of the invention, showing the blade-body fully contacting the jaws, with the arc chute being cross-sectioned along the section 5-5' of FIG. 5.

FIG. 2 shows a side view of an example embodiment of the invention, showing the knife blade switch 2 that includes jaws 10 and a blade body 4, each composed of a low resistivity metal, such as copper. The blade-body 4 is shown fully contacting the jaws 10. The jaws 10 is mounted on the base 24. An end-plate 6 composed of a higher resistivity metal, such as steel or a steel alloy, is fastened to the free end of the blade body 4. The steel end-plate 6 has a higher resistivity than the resistivity of the copper blade body 4 and copper jaws 10. The arc chute 14 is shown positioned at a location proximate to where the steel end-plate 6 of the blade disengages with the steel jaw-spring 12, to direct the arc and cool the hot arc gases. The jaws 10 may be coupled to a first electrical terminal 11. The blade body 4 has a first end mounted on a pivot 9 and coupled to a second electrical terminal 13. The pivot support 8 is mounted on the base 24. The blade body 4 is rotatable about the pivot 9 to electrically engage the jaws 10 in a closed position and to electrically disengage from the jaws 10 and a jaw-spring 12 in an open position. The jaw-spring 12 and the end-plate 6 have a higher resistivity than the blade body 4 and the jaws 10. The jaw-spring 12 is in contact with the end-plate 6 on the blade when the blade body 4 is disengaged from the jaws 10 as the blade rotates toward the open position. The jaw-spring 12 is mounted on and in electrical contact with the jaws 10, and extends upward above the jaws 10, extending beyond the border of the jaws in the direction of the arc chute 14. There is a greater resistance pathway formed when the end-plate 6 is in contact with the jaw-spring 12 than a resistance path through the blade body 4 when engaged with the jaws 10. The low resistivity metal of the blade body 4 and jaws 10 may be, for example, aluminum, silver or copper and the higher resistivity metal of the end-plate 6 and jaw-spring 12 may be, for example, steel, a steel alloy, or a refractory metal such as tungsten, molybdenum, or alloys thereof.

Figure 3:
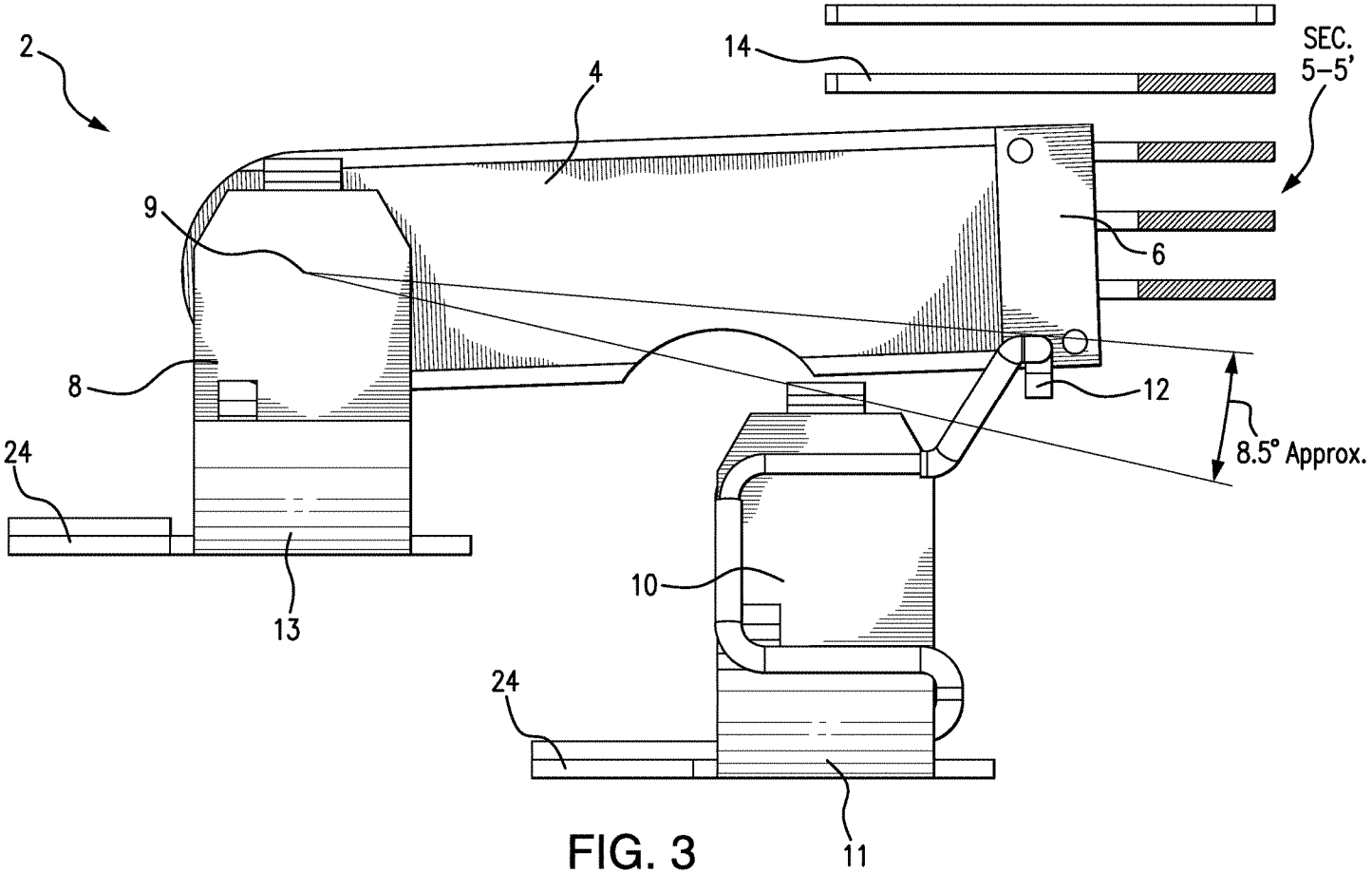
FIG. 3 shows a side view of an example embodiment of the invention, showing the blade end-plate contacting the spring contact, after the blade-body has moved upward and fully withdrawn from the jaws, with the arc chute being cross-sectioned along the section 5-5' of FIG. 5.

FIG. 3 shows a side view of an example embodiment of the invention, showing the blade end-plate 6 contacting the spring contact 12, after the blade-body 4 has been moved upward and fully withdrawn from the jaws 10. As the copper blade 4 is withdrawn from the copper jaws 10, the steel end-plate 6 of the blade remains in contact with a higher resistivity steel jaw-spring 12 mounted on the copper jaws 10. The connection of the steel end-plate 6 of the blade with the steel jaw-spring 12, imposes a greater resistance path for the current flowing through the switch 2 than the resistance path through the copper blade 4 and copper jaws 10, so that an arc formed has a diminished current when the contact separation occurs. The diminished arc current reduces erosion of the copper jaws and copper blade of the switch.

At least two properties of the material of the switch contacts affect the extent of arc erosion. First, the melting point of the contact material will affect the extent of arc erosion. A higher melting point material will reduce the extent of melting caused by the resistive heating as the switch starts to open. It will also reduce the extent of vaporization of the metal atoms when exposed to the ionized air molecules when the contacts begin to actually separate. The second property of the material is its hardness. A contact material having a higher hardness, will more readily resist the spallation and evaporation of the metal atoms when exposed to the positively charged ions and negative electrons of the plasma.

The steel end-plate 6 and the steel-jaw spring 12 may be composed of a material that has a higher melting point and higher hardness than the melting point and hardness of the copper blade 4 and the copper jaws 10. The steel end-plate 6 and the steel-jaw spring 12 may have a higher melting point material to reduce the extent of melting caused by the resistive heating as the switch starts to open. It will also reduce the extent of vaporization of the metal atoms when exposed to the ionized air molecules when the contacts begin to actually separate. The steel end-plate 6 and the steel-jaw spring 12 may be composed of a material that has a higher hardness, to more readily resist the spallation and evaporation of the metal atoms when exposed to the positively charged ions and negative electrons of the plasma.

By relocating the arc to the steel end-plate 6 and the steel-jaw spring 12, which occurs upon separation, arc erosion is substantially eliminated for the current carrying copper blade 4 and the copper jaws 10. In this manner, good contact joint integrity is maintained when the switch 2 is fully closed.

Examples of the low resistivity metal composing the blade body 4 and jaws 10 are shown as follows in Table I. The melting point and hardness of the example metals are also shown, for comparison with those for the end-plate 6 and jaw-spring 12.

TABLE I

| Metal | Resistivity (Ohm Meters) | Melting Point (° C.) | Vickers Hardness (MN m−2) |
|---|---|---|---|
| silver | 1.59 × 10^8 | 960 | 251 MN m−2 |
| copper | 1.68 × 10^8 | 1083° C. | 369 MN m−2 |
| aluminum | 2.65 × 10^8 | 659 | 167 MN m−2 |

Examples of the higher resistivity, higher melting point and higher hardness metal composing the end-plate 6 and jaw-spring 12 are shown in Table II:

TABLE II

| Metal | Resistivity (Ohm Meters) | Melting Point (° C.) | Vickers Hardness (MN m−2) |
|---|---|---|---|
| steel | 11.8 × 10^8 | 1535 | 608 MN m−2 |
| tungsten | 5.6 × 10^8 | 3370 | 3430 MN m−2 |
| molybdenum | 53.4 × 10^8 | 2620 | 1530 MN m−2 |

Figure 4:
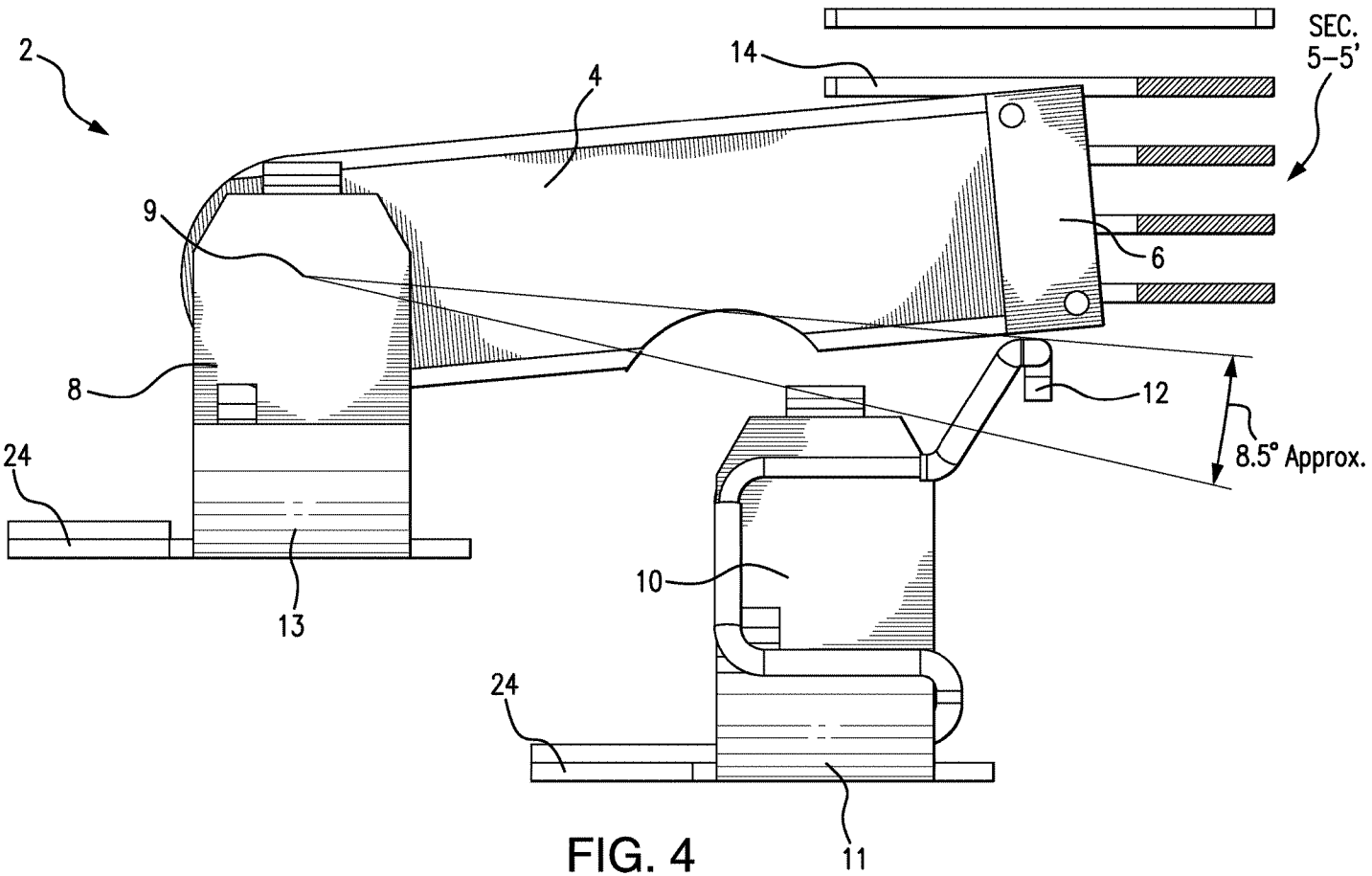
FIG. 4 shows a side view of an example embodiment of the invention, showing the blade end-plate moving upward and no longer contacting the spring contact, with the arc chute being cross-sectioned along the section 5-5' of FIG. 5.

FIG. 4 shows a side view of an example embodiment of the invention, showing the blade end-plate 6 moving upward and no longer contacting the spring contact 12. An arc chute 14 is positioned at a location proximate to where the steel end-plate 6 of the blade disengages with the steel jaw-spring 12, to direct the arc and cool the hot arc gases. The arc chute 14 may be fastened to the same base 24 that supports the switch 2. The arc chute sends the arc against an arc plate stack, arranged at right angles to the main arc column in order to split the arc up into a number of elementary arcs, each of them thus generating a minimum arcing voltage due to its elongation.

Example embodiments of the knife blade switch 2 may be manually actuated or automatically actuated. Examples of an automatic actuation mechanism may include an electrically driven solenoid, gear motor, or linear motor that rotates the blade-body 4 about the pivot 9, to either open or close the switch. The application of such an electrically driven actuator enables a fast insertion or withdrawal of the blade end-plate 6 as it engages or disengages with the steel jaw-spring 12. A faster speed in the air, before insertion or after withdrawal, will reduce the duration of the arc in the air and thus the energy that it dissipates.

During the interval when the blade end-plate 6 is in contact with the steel jaw-spring 12, the current flowing through the switch is reduced because it must flow through a greater resistance path. The reduction in the current will diminish any arc formed when the contact separation occurs. For example, the relative position of the pivot 9 and the top of the jaws 10 shown in FIG. 4, may be designed to enhance the reduction in the current, based on the estimated speed that an electrically driven actuator can move the blade end-plate 6 through the steel jaw-spring 12. By increasing the duration that the current must flow through the higher resistance path of the end-plate 6 and the steel jaw-spring 12, more energy is dissipated that would otherwise contribute to forming the arc. For example, an estimated angular speed for a particular type of actuator may be approximately 3000 degrees per second. In the example shown in FIG. 4, there is an 8.5 degree angular-arc of travel by the blade-body 4 about the pivot 9, while the blade end-plate 6 is in contact with the steel jaw-spring 12. The duration of the higher resistance contact is therefore 8.5/3000 or 2.8 milliseconds before the arc can start. Increasing the angular-arc of travel by the blade-body 4 about the pivot 9, while the blade end-plate 6 is in contact with the steel jaw-spring 12, can further reduce the energy of the arc formed when the contact separation occurs.

Figure 5:
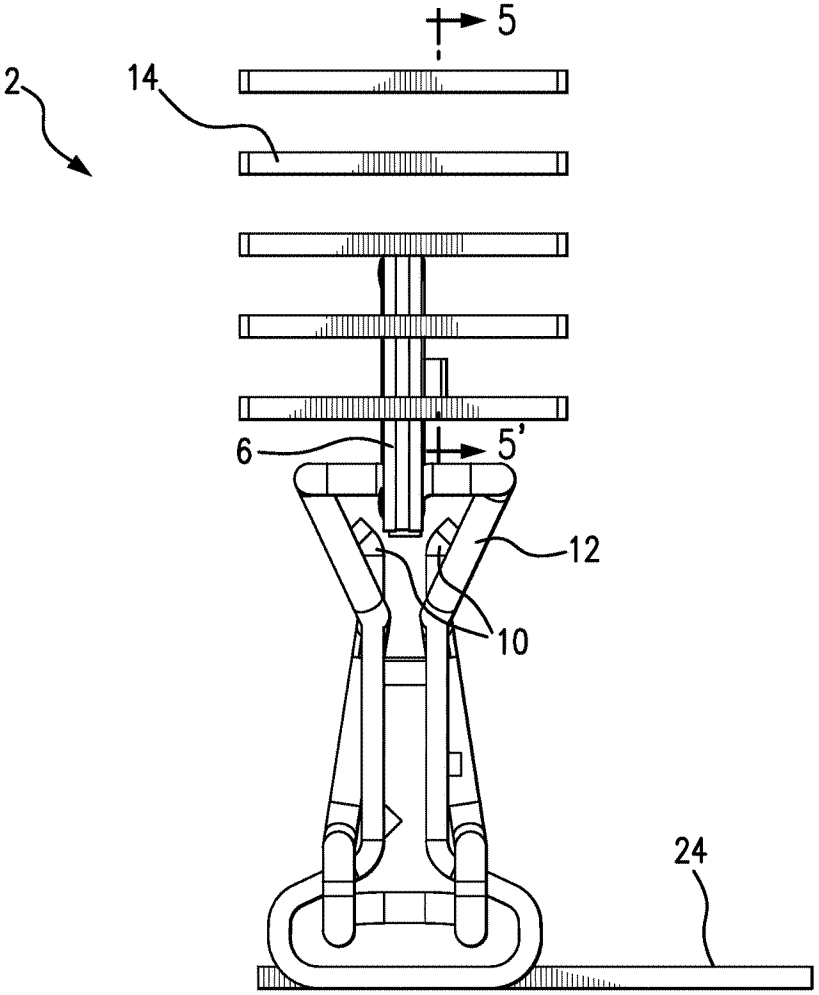
FIG. 5 shows an end view of an example embodiment of the invention, showing knife blade switch and its relationship with the arc chute that is shown with the section line 5-5'.

FIG. 5 shows an end view of an example embodiment of the invention, showing knife blade switch and its relationship with the arc chute that is shown with the section line 5-5'. The arc chute 14 is positioned to direct the arc, and cool and extinguish the hot arc gases produced when the blade end-plate 6 separates from the steel jaw-spring 12. The arc chute 14 may be an arrangement of metal or non-metallic plates that divide and cool the arc. Magnetic coils or permanent magnets may be used to deflect the electrically charged arc plasma into the arc chute 14.

Figure 6:
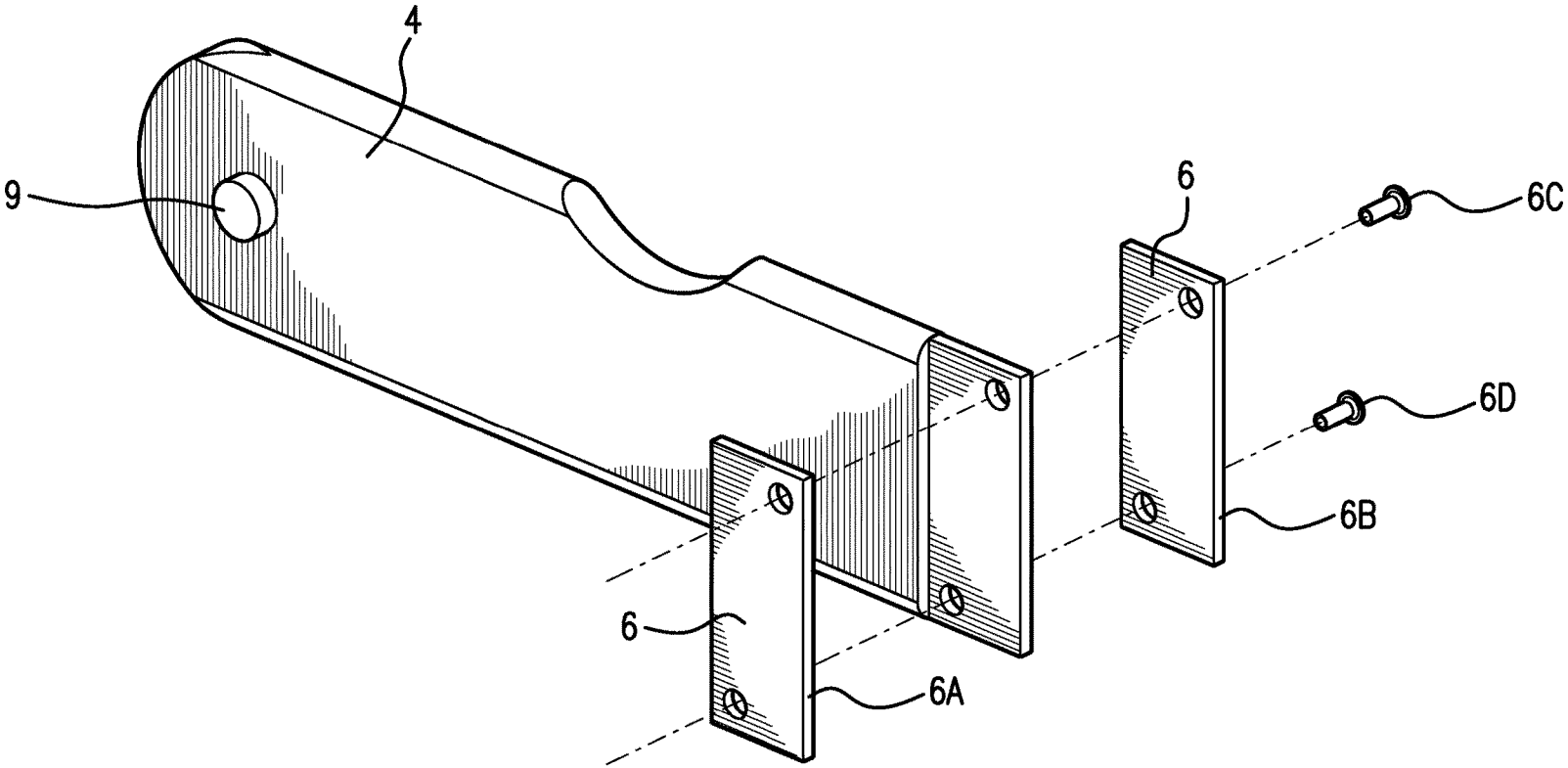
FIG. 6 shows a top perspective view from the left side, of an example embodiment of the invention, showing the blade-body 4 and the blade end-plate 6.

FIG. 6 shows a top perspective view from the left side, of an example embodiment of the invention, showing the blade-body 4 and the blade end-plate 6. The blade end-plate 6 may comprise two steel plates 6A and 6B, that are riveted by rivets 6C and 6D, on to opposite sides of the free end of the blade-body 4.

Although specific example embodiments of the invention have been disclosed, persons of skill in the art will appreciate that changes may be made to the details described for the specific example embodiments, without departing from the spirit and the scope of the invention.

The invention claimed is:

1. A knife blade switch, comprising:

jaws to be coupled to a first electrical terminal, the jaws having an electrical resistivity;

a jaw-spring mounted on the jaws, the jaw-spring having an electrical resistivity greater than the electrical resistivity of the jaws;

a blade having a body with a first end and a second end opposite the first end, the first end mounted on a pivot, the pivot to be coupled to a second electrical terminal, the blade having an electrical resistivity;

the second end having a plate fastened thereto, the plate having an electrical resistivity greater than the electrical resistivity of the blade;

the blade rotatable about the pivot to electrically engage the body and jaws in a closed position and to electrically disengage from the jaws and the jaw-spring in an open position;

wherein the jaw-spring and the plate have a higher resistivity than the body of the blade and the jaws, and the jaw-spring extending beyond a border of the jaws in a direction from the closed position to the open position, the jaw-spring remaining in contact with the plate on the blade when the body of the blade is disengaged from the jaws as the blade rotates beyond the border of the jaws toward the open position, the jaw-spring and the plate on the blade forming a greater resistance path for current flowing through the jaw-spring and the plate than a resistance path through the blade and jaws, the extension of the jaw-spring beyond the border of the jaws on which it is mounted, configured to increase a duration that the current must flow through the greater resistance path through the jaw-spring and the plate as the switch is opened, thereby dissipating increased energy of an arc formed when the plate separates from the jaw-spring.

2. The knife blade switch of claim 1, wherein the body of the blade and the jaws consist essentially of copper and the plate and the jaw-spring consist essentially of steel.

3. The knife blade switch of claim 1, further comprising:

an arc chute positioned at a location proximate to where the plate disengages from the jaw-spring.

4. The knife blade switch of claim 3, further comprising:

the jaw-spring extending beyond the border of the jaws in the direction of the arc chute.

5. A knife blade switch, comprising:

jaws consisting essentially of a low resistivity metal to be coupled electrically to a first electrical terminal;

a blade comprising a body consisting essentially of a low resistivity metal and mounted on a pivot, and a metal plate fastened to a free end of the body of the blade, the metal plate having a higher resistivity than resistivity of the body of the blade and of the jaws, the blade to be coupled electrically to a second electrical terminal, the blade to rotate about the pivot to fit within the jaws to make electrical connection with the jaws;

a jaw-spring mounted on, extending from and electrically coupled to the jaws, the jaw-spring having a higher resistivity than the resistivity of the body of the blade and of the jaws, the jaw-spring remaining in electrical connection with the metal plate of the blade when the body of the blade is withdrawn from fitting within the jaws, and the law-spring extending beyond a border of the jaws in a direction from a closed position to an open position, the electrical connection of the jaw-spring and metal plate of the blade forming a greater resistance path for current flowing through the jaw-spring and the plate than a resistance path through the body of the blade and the jaws, the extension of the jaw-spring beyond the border of the jaws on which it is mounted, configured to increase a duration that the current must flow through the greater resistance path through the law-spring and the plate as the switch is opened, thereby dissipating increased energy of an arc formed when the plate separates from the jaw-spring.

6. The knife blade switch of claim 5, wherein the low resistivity metal is selected from the group consisting of aluminum, silver and copper and the higher resistivity metal is selected from the group consisting of steel, steel alloys, and a refractory metal.

7. The knife blade switch of claim 5, wherein the metal plate and jaw-spring are composed of a higher melting point material than the melting point of the material composing the blade and the jaws.

8. The knife blade switch of claim 5, wherein the metal plate and jaw-spring are composed of a higher hardness material than the hardness of the material composing the blade and the jaws.

* * * * *